United States Patent [19]

Hussey et al.

[11] Patent Number: 5,042,558

[45] Date of Patent: Aug. 27, 1991

[54] FASTENER DISPENSING NEEDLE AND METHOD OF MAKING

[75] Inventors: Steven J. Hussey, Milford, Mass.; William J. Cooper, Woonsocket, R.I.; Charles L. Deschenes, North Attleboro, Mass.

[73] Assignee: Dennison Manufacturing Company, Framingham, Mass.

[21] Appl. No.: 505,812

[22] Filed: Apr. 6, 1990

[51] Int. Cl.[5] ..... B21G 3/18; C21D 1/00

[52] U.S. Cl. ..... 163/5; 148/12 R; 148/12.4; 148/320

[58] Field of Search ..... 112/222; 163/5; 148/12 R, 12.4, 320; 223/102; 227/67

[56] References Cited

U.S. PATENT DOCUMENTS 3,470,834 10/1969 Bone ..... 223/104

4,039,078 8/1977 Bone ..... 227/67

*Primary Examiner*—R. Dean

*Assistant Examiner*—Robert R. Koehler

*Attorney, Agent, or Firm*—Arthur B. Moore

[57] ABSTRACT

A fastener dispensing needle is manufactured by a machining process which includes bending a metal tube to assist in obtaining an important configuration for the tip of the needle. A flared portion of the needle tip determines the diameter of the hole made through the material of the object being penetrated by the needle. This flared portion is sized to make a hole at least large enough to overlap with the diameter of the central bore through the needle. This minimizes unnecessary stresses on the fastener as it is ejected from the needle, thus resulting in fewer undesired breakages of the fasteners. In addition, the area of the needle where the central bore and longitudinal groove merge into the tip portion of the needle is configured to minimize cutting action on the filament of the fastener, again resulting in fewer undesired breakages.

14 Claims, 3 Drawing Sheets

FASTENER DISPENSING NEEDLE AND METHOD OF MAKING

BACKGROUND OF THE INVENTION

This invention relates to needles and, more particularly, to needles used with plastic fasteners in order to insert the fasteners into objects to be marked or attached.

Needles of this type are disclosed in U.S. Pat. Nos. 3,470,834, 3,759,435, Re. 29,310, Re. 29,819, and 4,039,078, all issued in the name of Arnold R. Bone and assigned to Dennison Manufacturing Company. Such needles are especially designed to dispense plastic fasteners of the type disclosed in U.S. Pat. No. 3,103,666 (see FIG. 2, showing one such needle), including on at least one end a cross-bar or T-bar joined to a thin, strong filament. Where T-bars are provided at both ends of the filament (or "connector"), as in U.S. Pat. No. 4,039,078, two needles are provided, one for each T-bar. Such needles include a central bore to guide the T-bar, and a longitudinal slot to guide the filament, of a fastener to be dispensed. In addition, these needles can have a cutter included as an integral part of the needle design, or the needle can be designed without a cutter, in which case a knife or cutting surface would be included separately to provide the cutting function.

Needles of the prior art are typically made by relatively involved machining processes. For example, one typical method of manufacturing a needle involves taking a solid metal cylindrical blank, or workpiece, with a point at one end and machining a longitudinal groove down one side of the blank. The groove is then compressed, or clinched over, in order to form sidewalls which will guide the filament of a plastic fastener. The problem with this type of needle is that the groove's sidewalls do not have the proper configuration to provide the necessary guidance.

When the groove is clinched over, the originally parallel sidewalls are canted toward each other, resulting in angled sidewalls which provide minimal contact surface for the fastener filament passing through the needle. These angled sidewalls allow the cross-bar of the fastener to be pulled away from the center of the needle. In addition, the surface texture of the resulting sidewalls do not typically have the smoothness required to ensure easy passage of a fastener filament. In fact, the needle sidewalls often are so rough as to contribute to breakage of the fastener filaments during application.

Another problem is that the diameter of the front portion of the needle tip is not optimized relative to the diameter of the central bore through the needle. This causes the material of the object being penetrated by the needle to impinge upon the fastener, especially in the vicinity of the junction of the cross-bar with the filament of the fastener. This impingement adds enough stress to the junction area to cause breakage in too many cases.

Still another problem exists in the configuration of the needle at the critical area where the central bore and longitudinal slot merge into the tip portion. The configuration of the prior art allowed this critical area to actually serve as somewhat of a cutting edge by adding sufficient stress to the fastener cross-bar and filament junction to cause breakage, similar to the effect of cutting through the filament near the junction with a knife.

Accordingly, it is an object of the invention to provide a needle having more consistent dimensions than those of the prior art. More specifically, it is an object of the invention to provide groove sidewalls which have an appropriate configuration and adequate physical dimensions, as well as an adequately smooth surface texture, to facilitate the insertion of plastic fasteners into desired objects without breaking the filaments of the fasteners.

A further object of the invention is to optimize the diameter of the front portion of the needle tip relative to the diameter of the central bore through the needle in order to minimize unnecessary stress which results in breakage of the fasteners.

A still further object is to provide a proper configuration for the critical area where the central bore and the longitudinal slot merge into the tip portion of the needle in order to minimize the possibility of this area acting as a cutting edge on the fastener.

BRIEF DESCRIPTION OF THE DRAWINGS

The above and additional aspects of the invention are illustrated in the following detailed description of a preferred embodiment of a fastener dispensing needle, which should be consulted together with drawings in which.

SUMMARY OF THE INVENTION

In furthering the above and additional objects, the invention provides a needle for inserting plastic fasteners into objects to be marked or attached, such fasteners including at least one cross-bar and a filament transversely joined to said cross-bar. The fastener dispensing needle has a shank with a central bore and a longitudinal groove extending radially outwardly from the bore through the shank so as to form groove sidewalls with a predetermined configuration having consistent, adequate dimensions and a smooth surface texture, both of which minimize breakage of the filaments of the plastic fasteners. A transition region between the shank and the tip portion of the needle has a configuration which minimizes stress on the filament as the fastener exits the needle during application. In addition, the tip portion of the needle has a flared portion with a diameter which at least overlaps the diameter of the central bore of the needle as the needle penetrates an object. This again minimizes stress on the fastener filament, especially at the junction of the cross-bar and filament, by helping to keep the material of the object being penetrated by the needle from impinging on the fastener as it exits from the needle.

DETAILED DESCRIPTION

Figure 3:
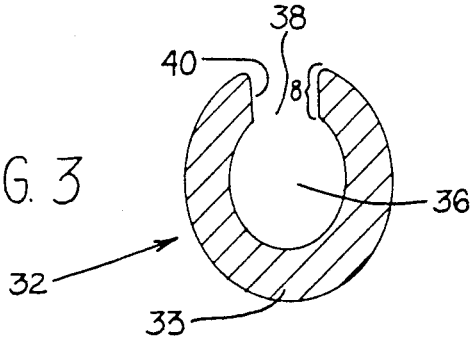
FIG. 3 is a sectional view of a needle of the present invention, taken along line 3—3 of FIG. 6, illustrating its longitudinal groove and the sidewalls of the groove.
Figure 4:
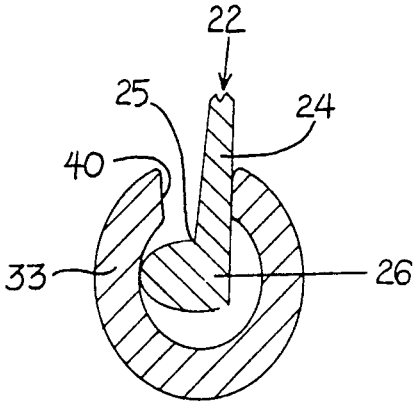
FIG. 4 is the same sectional view of FIG. 3, with a plastic fastener depicted during passage through the needle, similar to the view shown in FIG. 2.
Figure 6:
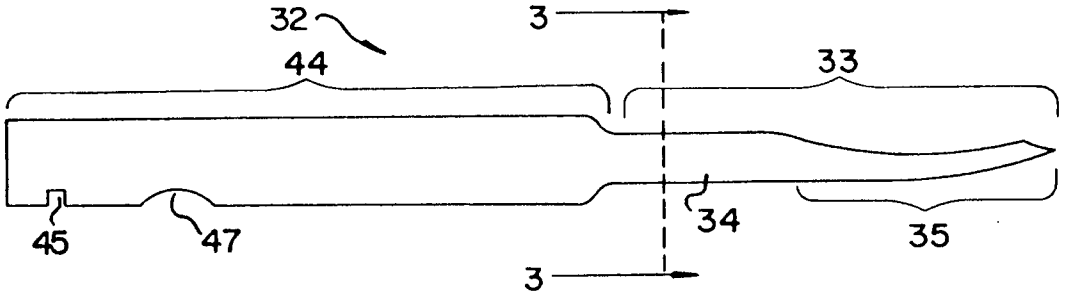
FIG. 6 is an elevational view of the needle shown in FIGS. 3 and 4, depicting the outer contours of the needle and the relative positions of certain portions of the needle.

With reference to the drawings, a preferred embodiment of the present invention is illustrated in FIGS. 3, 4 and 6.

Figure 5:
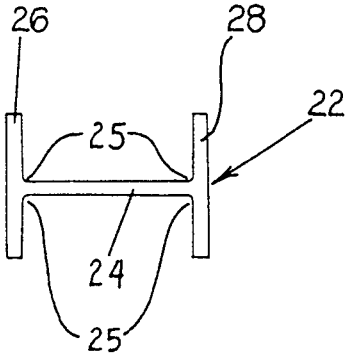
FIG. 5 is a plan view of one type of plastic fastener which may be applied by the needle of the present invention, the fastener being similar to those shown in FIGS. 2 and 4.

Turning first to FIG. 5, a typical plastic fastener 22 is illustrated to show the component parts, cross-bars 26 and 28 and filament 24. Junction 25 of the filament and each cross-bar is routinely subjected to relatively high stresses during the application process. The illustrative fasteners depicted in FIGS. 2 and 4 are of the type shown in FIG. 5.

Figure 1:
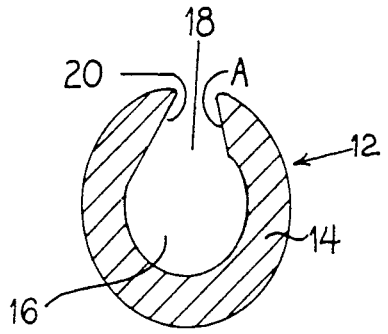
FIG. 1 PRIOR ART
FIG. 1 is a sectional view of a prior art needle, depicting a longitudinal groove in the needle and the sidewalls of the groove.
Figure 2:
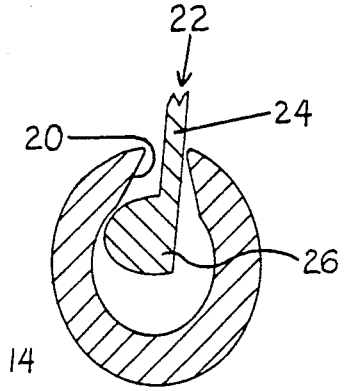
FIG. 2 PRIOR ART
FIG. 2 is the same sectional view of the prior art needle shown in FIG. 1, with a plastic fastener cross-bar and filament depicted during passage through the needle.

Turning now to FIGS. 1 and 2, a typical prior art needle 12 is shown in cross-section. The needle comprises a shank 14 with a longitudinal bore 16 through its center. A groove 18 projects radially outwardly from bore 16 to the outside of needle 12. Groove 18 has two sidewalls 20 over which plastic fastener filaments pass as they are forced through the needle 12 during insertion. An example of a plastic fastener 22 passing through a needle 12 is illustrated in FIG. 2. As can be seen in FIGS. 1 and 2, the effective contact surface of the sidewalls presented to the fastener filament passing through the needle is minimal (see surface A in FIG. 1). Although these views are somewhat exaggerated, the point is that the sidewalls do not provide the optimal surface for the passage of the plastic fastener filaments. The canted sidewall surfaces allow the cross-bar 26 (FIG. 2) to be pulled away from the center of bore 16, thus reducing the clearance between cross-bar 26 and the material (not shown) of the object being penetrated by needle 12. This increases the frictional forces between the fastener filament 24 and the penetrated material, thus increasing premature fastener failures due to breakage, jamming in the needle, and higher forces required to push the fastener through the needle.

Turning now to FIGS. 3 and 4, similar views of the fastener dispensing needle 32 of the present invention are shown to facilitate comparison with the prior art. Shank 33, central bore 36, groove 38, and sidewalls 40 correspond to the components illustrated in FIGS. 1 and 2 and described above. As FIGS. 3 and 4 clearly show, the sidewalls 40 of the needle are substantially parallel and provide a more adequate surface area (see surface B in FIG. 3) for guiding the fastener filaments during their passage through the needle during application than do sidewalls of FIGS. 1 and 2. This cross-sectional configuration illustrated in FIGS. 3 and 4 also tends to retain cross-bar 26 nearer the center of bore 36, thus maintaining adequate clearance between cross-bar 26 and the material of the object being penetrated and surrounding needle 32. In addition, the sidewalls 40 of the needle of the present invention have a smoother surface texture than typically found in the prior art, thereby further minimizing problems such as fastener breakage during application.

As shown in FIG. 6, needle 32 comprises a shank portion 33 and a base portion 44. The shank portion 33 includes a shank 34 and a tip 35 which facilitates insertion of the needle through the objects to be marked or attached, as well as providing egress means for the plastic fastener.

Figure 7:
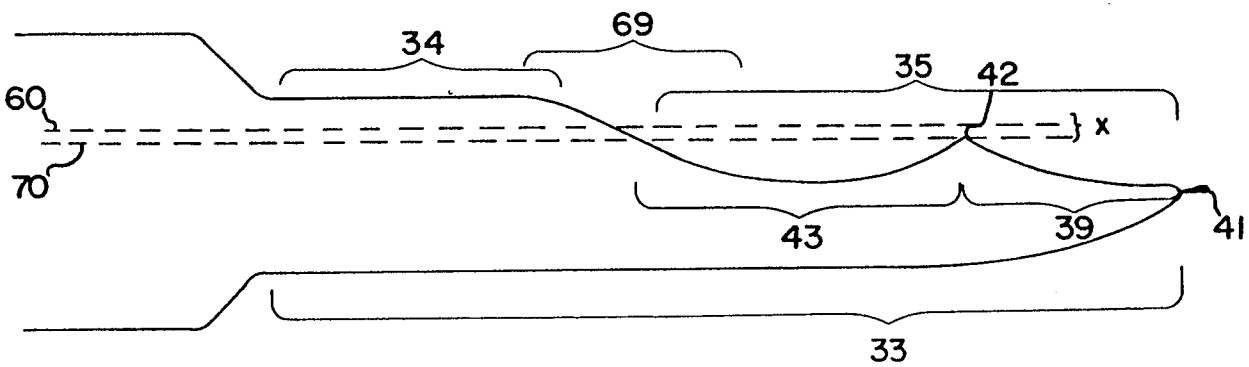
FIG. 7 is an enlarged fragmentary elevational view of the needle of FIG. 6, which is somewhat exaggerated in order to illustrate the relative positions of different parts of the needle and give a more detailed view of some parts.

As best seen in FIG. 7, tip 35 comprises a point 41, a flared portion 39 behind the point, and a spoon-shaped portion 43 behind the flared portion 39. The maximum diameter of flared portion 39 is indicated by peak 42 of the profile shown in FIG. 7. Point 41 has a radius to make it relatively blunt in order to minimize damage to the material being penetrated by the needle. For example, a very sharp point could cause damage to the fabric material of an item of clothing to which a price tag is attached. The diameter at 42 is at least large enough to overlap the cross-sectional area defined by central bore 36 (see FIG. 3). Line 70 in FIG. 7 corresponds to the inner surface of bore 36, as well as the innermost surface of the sidewalls 40. Peak 42 must at least reach this line 70 in the needle of the present invention. This results in the flared portion 39 spreading the material being penetrated, e.g. cloth, to form a hole which is large enough to prevent the cloth or material from impinging against the cross-bar/filament junction 25 of the fastener 26 (see FIGS. 4 and 5) as the fastener exits the needle. This reduces stress on the critical junction 25 so as to minimize undesired breakages of the fastener, usually at the junction 25. Control of the dimensions of the sidewalls 40 ensures this overlap described above. FIG. 7 shows the innermost surface 70 of sidewalls 40 for the needle of the present invention, as well as the innermost surface 60 of the sidewalls of the prior art. The difference in diameter between surfaces 60 and 70 is indicated by the "x" in FIG. 7. This distance "x" is critical in reducing undesired breakage of the fasteners.

In addition, FIG. 7 illustrates the gradual slope of the transition region 69 between shank 34 and tip 35. This reduces the stress applied to the fastener as it exits the needle, especially when the needle overtravels as the fastener is being ejected. The prior art had a more abrupt slope in this transition region, which resulted in higher stresses being applied to the fastener as it made contact with the transition region of the needle. These higher stresses resulted in undesired breakage of the fastener, somewhat similar to a cutting action. The gradual slope of region 69 of the needle of the present invention reduces this cutting action and minimizes these undesired fastener severances.

The base 44 has a notch 45 which provides means for attaching needle 32 to an attachment device which applies plastic fasteners. In addition, base 44 has a hollow 47 which allows the needle to be fixed in a desired position and orientation in the fastener attachment device.

Figure 8:
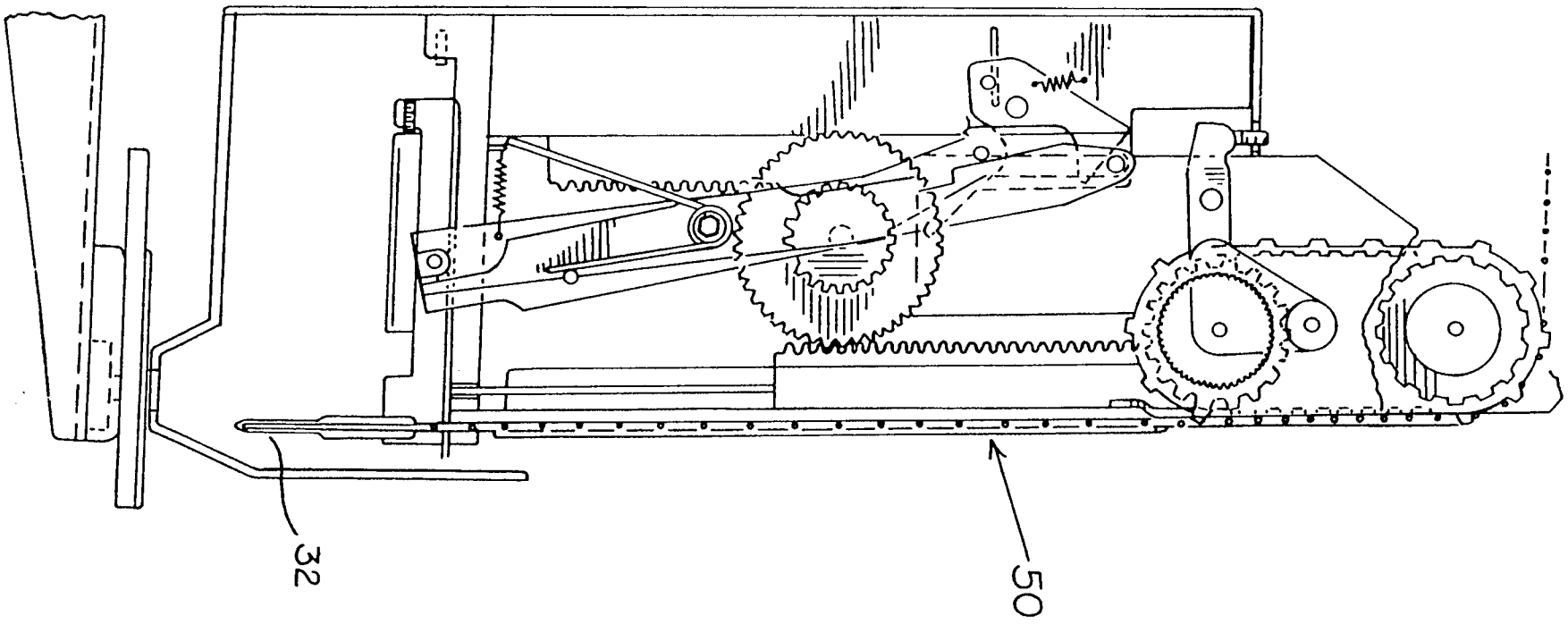
FIG. 8 is a perspective view of an attachment device which utilizes needles of the present invention for applying plastic fasteners to objects to be marked or attached.

Finally, FIG. 8 illustrates a typical attachment device 50 which could utilize the fastener dispensing needle of the present invention to apply plastic fasteners of the type illustrated in FIG. 5. U.S. Pat. No. 4,887,172, assigned to Dennison Manufacturing Company, is incorporated by reference to provide an example of one such application device.

The fastener dispensing needle of the present invention is made by a machining process having the following basic steps:

(a) cut a section of cylindrical metal tubing with a central bore to a desired length, and deburr the ends of the tubing;

(b) add a 90-degree countersink to a first end of the tubing to form a chamfered edge at the end of the tubing central bore;
(c) add a scallop having a predetermined radius in the side of the tubing, near the first end;
(d) grind or turn down the outer diameter of the tubing to a desired diameter;
(e) ream the inner diameter of the central bore of the tubing to a desired diameter;
(f) bend the second end of the tubing to form a needle tip portion having a desired radius for its inner surface;
(g) turn down the same end in preparation for grinding;
(h) grind the end to form a needle tip point portion having a point with a specified radius and a flared section with a desired diameter;
(i) turn down a portion of the tubing, adjacent the tip portion, to form a needle shank portion with a desired diameter;
(j) mill the needle tip portion to make it spoon-shaped with a specified radius;
(k) cut a longitudinal slot in the side of the tubing to form a groove extending radially from the tubing central bore;
(l) add a 90-degree countersink to the end of said longitudinal groove at said second end of said tubing;
(m) deburr the final needle product;
(n) harden the needle metal, preferably to about Rc 45–50; and
(o) plate the needle, preferably with nickel about 0.0002" thick.

Modified embodiments of the needle of the present invention include needles having a knife edge or cutter as an integral part of the needle design, and needles for use with the attaching devices of U.S. Pat. No. 3,659,769, and U.S. Pat. No. 4,712,677.

We claim:

1. A process for manufacturing a needle for use in inserting plastic fasteners into objects to be marked or attached, said process comprising the following steps:
(a) cutting a section of cylindrical metal tubing to a predetermined length, said tubing having a first end and a second end, and a bore through the center of its longitudinal axis;
(b) deburring said first and second ends of said tubing;
(c) grinding or turning down the outer diameter of said tubing to a first predetermined diameter;
(d) reaming the inner diameter of said tubing bore to a second predetermined diameter;
(e) bending said first end of said tubing so as to form a needle tip portion having a first predetermined radius for its inner surface;
(f) turning down said first end in preparation for grinding;
(g) grinding said first end to form a needle tip point portion having a point with a second predetermined radius and a flared section with a third predetermined radius;
(h) turning down a portion of said tubing, adjacent said tip portion and including said second end, to form a needle shank portion having a third predetermined diameter;
(i) milling said needle tip portion so as to provide a spoon-shape having a fourth predetermined radius; and
(j) cutting a longitudinal slot in the side of said tubing so as to form a groove extending radially from said central bore.

2. A process according to claim 1, further comprising the steps of:
(k) adding a 90-degree countersink to said second end of said tubing after step (b) so as to form a chamfered edge at said second end; and
(l) adding a 90-degree countersink to the end of said longitudinal groove at said second end of said tubing.

3. A process according to claim 2, further comprising the steps of:
(m) adding a scallop having a predetermined radius in the side of said tubing, near said second end, after step (k); and
(n) deburring, hardening, and plating the resulting needle.

4. A process according to claim 3, wherein said needle is hardened to about Rc 45–50.

5. A process according to claim 3, wherein said needle is plated with nickel.

6. A process for manufacturing a needle for use in inserting plastic fasteners into objects to be marked or attached, said process comprising the steps of:
(a) providing a section of cylindrical metal tubing with a longitudinal central bore, said tubing having a predetermined length between first and second ends of said tubing, and a predetermined inner diameter and outer diameter;
(b) bending said first end of said tubing so as to form a needle tip portion having a first predetermined radius for its inner surface;
(c) machining said first end to form a needle tip point;
(d) turning down a portion of said tubing, adjacent said tip portion and including said second end, to form a needle shank portion having a third predetermined diameter;
(e) milling said needle tip portion so as to provide a spoon-shape; and
(f) cutting a longitudinal slot in the side of said tubing so as to form a groove extending radially from said central bore.

7. A process according to claim 6, further comprising the step of deburring said first and second ends of said tubing.

8. A process according to claim 6, wherein the providing step (a) includes the steps of grinding or turning down the outer diameter of said tubing, and reaming the inner diameter of said tubing bore.

9. A process according to claim 6, further comprising the steps of:
(k) adding a 90-degree countersink to said second end of said tubing after step (b) so as to form a chamfered edge at said second end; and
(l) adding a 90-degree countersink to the end of said longitudinal groove at said second end of said tubing.

10. A process according to claim 9, further comprising the steps of:
(m) adding a scallop having a predetermined radius in the side of said tubing, near said second end, after step (k); and
(n) deburring, hardening, and plating the resulting needle.

11. A process according to claim 10, wherein said needle is hardened to about Rc 45–50.

12. A process according to claim 10, wherein said needle is plated with nickel.

13. A process according to claim 6, wherein the machining step (c) results in a needle tip point with a second predetermined radius and a flare point with a third predetermined radius.

14. An improved needle for dispensing a fastener having a filament attached to at least one cross-bar, said needle being of the type including a shank portion for assisting in the penetration of objects to be marked or attached by said fastener, said shank portion comprising a shank and a tip and a transition region between said shank and tip; a base portion connected to said shank portion; a longitudinal bore through the center of said shank portion and said base portion, said central bore providing a passageway for one of said cross-bars of said fastener; a longitudinal groove extending from said central bore through said shank and base, said groove providing passage means for said filament of said fastener; and two groove edges, one on each side of said groove, wherein said groove edges guide said filament along said groove as said fastener is inserted into said objects to be marked or attached and retain said fastener cross-bar near the center of said bore;

wherein the improvement comprises manufacturing said needle from a hollow metal tubing having a central longitudinal bore and a predetermined inner and outer diameter, wherein said longitudinal groove is cut into the side of said tubing to form said groove so that it extends radially from said central longitudinal bore, whereby said groove edges have edge surfaces defined by radial sections of said tubing.

* * * * *